United States Patent [19]

Couchman

[11] 3,977,225

[45] Aug. 31, 1976

[54] FORGING METHOD

[75] Inventor: Richard Couchman, Clearwater, Fla.

[73] Assignee: Aluminum Company of America, Pittsburgh, Pa.

[22] Filed: Mar. 27, 1975

[21] Appl. No.: 562,867

[52] U.S. Cl. ..... 72/265; 29/1.3

[51] Int. Cl.[2] ..... B21C 23/20

[58] Field of Search ..... 29/1.3; 72/264, 265, 72/354, 347, 253

[56] References Cited

UNITED STATES PATENTS

| | | | |
|---|---|---|---|
| 2,183,637 | 12/1939 | Biginelli | 29/1.3 |
| 2,748,464 | 6/1956 | Kaul | 72/354 X |
| 3,197,857 | 8/1965 | Nippert | 72/265 X |
| 3,452,566 | 7/1969 | Archer et al. | 72/347 X |
| 3,820,374 | 6/1974 | Braueninger | 72/265 |

FOREIGN PATENTS OR APPLICATIONS

| | | | |
|---|---|---|---|
| 772,364 | 10/1934 | France | 72/265 |
| 1,452,306 | 2/1969 | Germany | 72/265 |

*Primary Examiner*—Travis S. McGehee
*Assistant Examiner*—Leon Gilden
*Attorney, Agent, or Firm*—Elroy Strickland

[57] ABSTRACT

Apparatus and a method of employment thereof for forging cylindrical shells of controlled interdimension wherein a single punch die mandrel and cushion cooperate at a single work station to subject a metal blank to high multi-axial stress sufficient to increase the ductility thereof and permit a completed article to be fabricated during a single continuous pass of the material through the die. Precise control of the interdimension of the desired part is maintained by means precisely shaping the material and maintaining engagement between the end face of the mandrel and the bottom of the work blank during the forging process.

13 Claims, 7 Drawing Figures

FORGING METHOD

BACKGROUND OF THE INVENTION

This invention relates generally to the fabrication of elongated tubular articles and, more particularly, to an improved method and apparatus for the fabrication of cartridge cases or the like.

Ammunition cartridge cases and similar cup-shape workpieces have previously been made in many cases by forming a recess in a solid, square, or cylindrical blank in a forging press and only thereafter shaping the blank in a forging machine to stretch it and give it final form. Two separate machines are required in such an operation and the workpiece must be introduced into and taken out from one machine and then reintroduced into the next machine. Obviously, such operations are time consuming and expensive. Presses having several tools are known in which essentially the same operations are performed in a single machine, however, the workpiece must also be brought manually from one tool to the other in such a case.

Typical of the prior art (illustrating the use of separate tooling and/or forging presses for fabricating cartridge cases or the like) are: Kaul, U.S. Pat. No. 2,891,298 which illustrates the steps of forwardly extruding and drawing the walls of a rocket shell in the process of fabricating the shell utilizing separate dies; Parre et al, U.S. Pat. No. 2,736,085, illustrating the use of two dies and punches to fabricate a cartridge case from bar stock, with the second die and punch forwardly extruding the wall of the case following an initial press of the stock against a bottom plug; and Hilton et al, U.S. Pat. No. 3,498,221, which illustrates the use of separate tooling and presses for making cartridge cases by first backwardly extruding a solid, cylindrical blank, followed by a drawing operation to thin and elongate the walls of the extruded blank.

It is known to fabricate various tubular articles utilizing a single press and single set of tooling and Kreidler, U.S. Pat. No. 2,893,553, is illustrative of a method and apparatus for fabricating tubular metal articles open at both ends from an initially hollow stamping. Kreidler illustrates a single operational sequence wherein the hollow stamping is placed within a die cavity which is initially closed at one end by a cushion, and a separately translatable punch and mandrel first cause the back extrusion of the workpiece to form an integral head thereon and thereafter the cushion moves away from the end of the die to permit the forward extrusion of an elongated tubular portion.

It is known in the art to fabricate cartridge cases in a single sequence of operations utilizing a single set of tooling as is taught by Talbot-Crosbie et al., U.S. Pat. No. 2,140,775. Talbot-Crosbie et al., illustrates the use of a punch and mandrel designed to forwardly extrude a billet through a die in a process of fabricating a shell case, with the punch also functioning as a blank holder in cooperation with the die. A bottom cushion is used for an initial forging action, with the cushion thereafter yielding to permit extrusion of the shell. The operation is continuous and utilizes the same tooling for all forming stages. However, in certain applications, it is extremely important to precisely control the interior shape and dimensions of the cartridge cases and techniques such as taught by Talbot-Crosbie et al. do not admit of such precise control. In a process such as is taught by Talbot-Crosbie et al., the material of the workpiece will be extruded ahead of the mandrel and the extrusion speed will increase as the corner of the mandrel approaches and enters the die orifice causing the bottom of the shell casing being formed to actually move away from the head of the mandrel. The duration of this phase depends on whether the corner between the front face of the mandrel and the side of the mandrel is sharp, radiused, chamferred or tapered; being a minimum for a sharp corner. Obviously, with large tolerances on the dimensions of the interior shape of the part being produced, the method and apparatus of Talbot-Crosbie et al. may produce acceptable parts, but such large tolerances are not usually found in present-day cartridge cases.

Techniques for controlling the interior shape of tubular articles such as cartridge cases are known but generally involve the use of extremely complex and expensive equipment. By way of example, Frothingham U.S. pat. No. 2,368,980 illustrates an elaborate mechanism and process capable of maintaining the position of a mandrel fixed relative to a die, fixed relative to the closed end of the part, or variable and controlled relative to the part. Frothingham apparently has the potential to control the internal dimensions and contour of the part, but at the sacrifice of cost and simplicity.

In addition to the operational and tooling constraints imposed by the necessity of maintaining close dimensional tolerances on the interior of the case being produced, an additional constraint is imposed by the inability of the material of the workpiece to undergo more than a predetermined decrease in cross-sectional area or in wall thickness in a single forging operation. Such a predetermined reduction is a function of the ductility of the workpiece's material.

Shortly before the outbreak of World War II, it was discovered that ordinary steels increase enormously in ductility when exposed to hydrostatic pressures in the range between 300,000 and 450,000 psi. This effect, as it applies to metal deformation generally, was first systematically studied by P. W. Bridgman in the early 1940's and his studies were compiled into a book entitled "Studies in Large Plastic Flow and Fracture", McGraw-Hill Book Company, Inc. 1952. Bridgman conducted experiments in drawing and extruding wire through a die in a high pressure liquid environment and found very significant increases in the degree to which the cross-sectional area of the work material could be reduced in a single pass. However, Bridgeman stated that, if one attempts to extrude material (without the aid of the hydrostatic pressure from the high pressure liquid filling the chamber) by pushing directly on the material as with a piston, it will be found that the pressure will not be transmitted to the extruding orifice because of lateral friction on the sides of the chamber, so that pressures high enough to split the extruding chamber will be reached before extruding begins.

Since the Bridgman work, many other investigators have duplicated, continued, and improved upon the techniques for high pressure fluid extrusion. Nevertheless, most of the work that has been done has been limited to unusual materials of limited interest in everyday applications. In addition, the investigation of processing under pressure has been almost wholly concerned with fluid extrusion of rods and tubes.

In 1967, in a paper entitled "Controlled Ductility Forming" presented before the International Conference on Manufacturing Technology at the University of Michigan in September, 1967, by F. J. Fuchs, Jr., there was described a high pressure shell drawing technique making use of the combined action of both high pressure fluid on the draw punch and shell blank to effect the desired metal deformation. "Controlled ductility" forming as used by Fuchs is stated to encompass all forming processes which make use of the effect of high pressure on ductility. Fuchs goes on in the same paper to describe an extension of the deep drawing controlled ductility forming technique in the absence of a fluid medium. The basic tooling envisioned by Fuchs comprised a die plate and a punch plate which were milled out in such a way as to provide guide grooves and a back support for a set of four or more edge pressure members. These members create an iris configuration which can open or close without forming gaps at the corners of the work blank. These edge punches are driven inward by a set of four high capacity rams, and the cooperation of the edge punches and the die and punch plates pressing against the work blank can raise the state of stress in the blank to very high and controllable triaxial compression. According to Fuchs, the ductility of the work blank can be just as effectively controlled as was the case with high pressure fluid.

Notwithstanding the teachings of Fuchs, that the use of a high pressure fluid medium could be dispensed with in increasing the ductility of the workpiece, it must nevertheless be appreciated that Fuchs' system is exceedingly complex, expensive and difficult to control in that he utilizes a minimum of six distinct and separately controlled pressure applying members to effect the desired state of stress in the work blank.

In view of the foregoing, it is an object of the present invention to provide an improved method and apparatus for the fabrication of tubular metal articles, the internal dimensions of which are accurately controlled.

Another object of the instant invention is to provide an improved method and apparatus for the forging of cartridge cases or the like whilst providing precise control of the internal dimensions of such cartridge cases and making use of the principle of increased ductility of the workpiece under stress.

Yet another object of the present invention is to provide a method and apparatus for the forging of tubular metal articles such as ammunition shells or the like more quickly and more efficiently than has heretofore been effected.

It is a further object of the subject invention to provide an improved method and apparatus for the fabrication of metal cartridge cases or the like having precisely controlled internal dimensions utilizing a single set of tooling with the work blank positioned at a single work station.

It is still a further object of the present invention to provide an improved method and apparatus for the fabrication of metal cartridge cases or the like wherein a work blank is fabricated by a single set of tooling during a single continuous operating cycle, which is effective to combine several, individual steps of a multiple step process into a single continuous operation.

It is a still further object of the instant invention to provide a simpler and more efficient method and apparatus for fabricating metal cartridge cases, wherein a work blank is positioned at a single work station, subjected to sufficient stress to increase its ductility, and subsequently forged into a cartridge case during a single operating sequence with a single pass of a tool or forming member.

SUMMARY OF THE INVENTION

The subject invention includes a method and apparatus for forming deep cylindrical shells such as cartridge cases from metal blanks. The apparatus envisioned includes a single die member having an opening of predetermined configuration defining a shoulder for receiving and supporting a cylindrical metal blank with a movable cushion member disposed beneath the die member at the exit face thereof, and a punch and contoured mandrel mechanism and assembly disposed above the die over the entrance face thereof.

The mandrel is generally in the form of a tapered cylinder which conforms very accurately to the desired internal dimension of the cartridge case to be fabricated. The punch is in the form of a hollow cylinder and the mandrel is disposed within the punch member co-axially therewith so as to be movable relative thereto. A cushion member is positioned beneath the die opposite the exit face thereof and means are provided for independently controlling the movement of each of the punch, mandrel and cushion members.

The process of the invention is initiated by placing the cylindrical blank on the shoulder within the die, with the punch, mandrel, and cushion retracted to an initial position remote from the die. Thereafter, the exit opening of the die is closed with the cushion member, and the punch and mandrel are moved into engagement with the word blank. At this time, the cushion is made to exert upward pressure sufficient for the subsequent movement of the mandrel to develop a predetermined bottom thickness of the part to be formed from the blank, which thickness may be equal to or less than the original thickness of the blank; the punch is made to exert downward pressure sufficient to make the blank fill the die during the subsequent movement of the mandrel; and the mandrel is moved into the blank to form a shallow, cup-shape workpiece having an integral side and end wall and an integral flange that is secured between the punch and peripheral shoulder of the die until the nose of the mandrel is entirely below the exit side of the die orifice.

Thereafter, the punch is moved toward the peripheral shoulder of the die to exert sufficient force to extrude the material of the flange and side wall through the die opening with the cushion member moving away from the die opening and the mandrel simultaneously advancing through the die opening, at the same speed as the cushion member, with the cushion member remaining in contacct with the end wall of the workpiece to prevent same from extruding ahead of the mandrel. Thus the dimension and configuration of the inner surface of the part is caused to conform to that of the mandrel.

The punch continues to advance until it reaches a fixed stop such that the thickness of the remaining flange is equal to the desired wall thickness of the open end of the finished part at which time the punch pressure is released while the punch maintains its position to thereby release the flange of the workpiece as the mandrel continues to advance to draw and iron the remainder of the blank. When the pressure of the punch on the flange is released, the cushion is fully retracted and after the workpiece has entirely passed through the die, the punch retracts together with the mandrel, thereby stripping the completed part from the mandrel and the punch and mandrel are retracted to their initial positions.

The extrusion, drawing and ironing pressure exerted by the punch and mandrel and the upward pressure exerted by the cushion during the above-described process effect a very high degree of stress within the work blank to effect a marked increase in the ductility thereof, thus permitting a relatively deep cylindrical part to be fabricated during a single pass of the mandrel. Further, the cushion prevents the bottom portion of the tubular part from extruding ahead of the face of the mandrel during the fabrication process to thereby insure close conformity of the interior of the part to the surface of the mandrel.

DESCRIPTION OF THE DRAWINGS

Other objects and many of the attendant advantages of the present invention will be better appreciated and said invention will become clearly understood with reference to the following detailed description when considered in conjunction with the accompanying drawings illustrating one embodiment of the instant invention, wherein.

DETAILED DESCRIPTION OF THE INVENTION

Figures 1, 2, 3, 4:
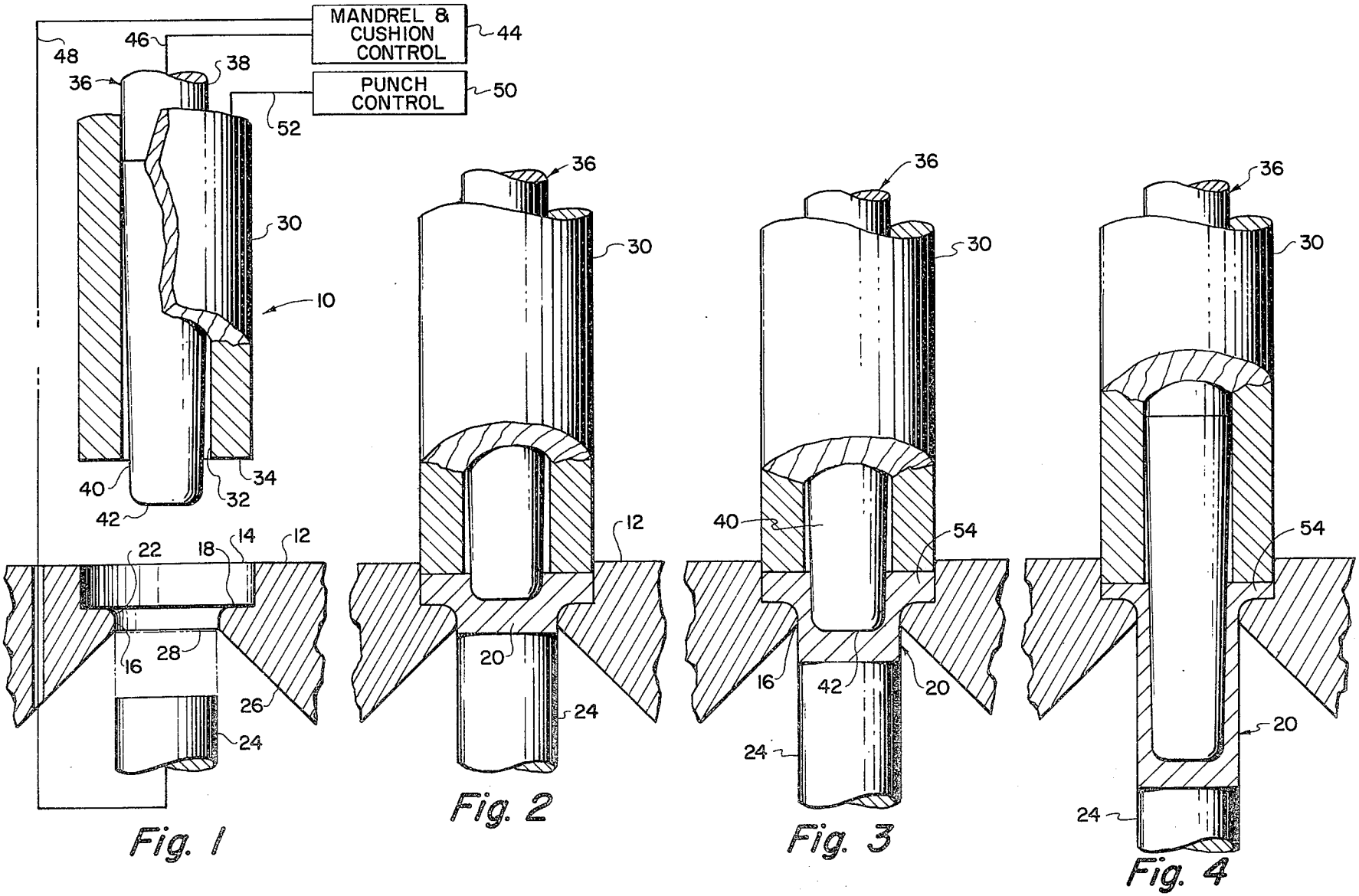
FIG. 1 provides a simplified diagramatic perspective of the apparatus of the subject invention partly broken away and with a component part in an initial position in solid line and a subsequent position in phantom line.
FIG. 2 provides a simplified perspective of the apparatus of FIG. 1 partly broken away and with the component parts thereof positioned corresponding to a second operational stage.
FIG. 3 provides a simplified perspective, partly broken away, of the apparatus of FIG. 1 with the component parts thereof positioned corresponding to said second operational stage.
FIG. 4 provides a simplified perspective, partly broken away, of the apparatus of FIG. 1 with the component parts thereof positioned corresponding to a third operational stage.

Referring to the drawings in more detail, and more particularly, to FIG. 1, the apparatus of the subject invention is illustrated generally at 10 and is seen to include fixedly positioned die means 12 configured to define an entrance aperture 14 and an exit aperture 16. The entrance aperture extends within the die means 12 to a shoulder portion 18 and a throat extends between said shoulder portion 18 and the exit aperture 16 and defines an extrusion orifice 22.

A generally cylindrical cushion 24 is positioned beeneath the exit aperture 16 coaxial with the extrusion orifice 22. The die means 12 is further provided with a frusto-conical surface 26 extending away from the exit aperture 16 and the generally cylindrical cushion 24 is provided with a flat end face 28 and is adapted to move from an initial position, illustrated in solid line, past the frusto-conical surface 26 to close the extrusion orifice 22.

A generally cylindrical punch 30 having a cylindrical opening 32 extending longitudinally therethrough and an annular end face 34 is positioned above the die means 12 and the entrance aperture 14 coaxial with the extrusion orifice 22, and is adapted to move toward and away from the die means 12, in a well-known manner, and a workpiece 20 (FIGS. 2 to 7).

A mandrel 36, having a cylindrical end portion 38 which extends to a frusto-conical or tapered end portion 40 that terminates in a flat end face 42, is illustrated slideably disposed within the cylindrical opening 32 of the punch 30 coaxial therewith and is adapted for sliding movement relative thereto and toward and away from the die means 12.

The die means 12, the cylindrical cushion 24, the punch 30 and the mandrel 36 may be mounted within a multiaction cam-controlled press in a conventional manner for independently controlled movement.

A mandrel and cushion control network is illustrated in block form at 44 and is connected via control lines 46 and 48 to the mandrel 36 and the cushion 24, respectively. Similarly, a punch control network is illustrated in block form at 50 and is connected to the punch 30 via a control line 52. It should be emphasized at this point that the mandrel and cushion control network 44 and the punch control network 50 comprise commonly available process control mechanisms and their respective details form no part of the present invention. It is merely necessary for the networks 44 and 50 to provide the control functions discussed herein in any of the various ways commonly employed in the art.

In the initiation of an operating sequence, the punch 30 and the mandrel 36 are in the positions illustrated in FIG. 1 remote from the die means 12, and the cushion 24 is in its solid line position (FIG. 1) with the extrusion orifice 22 open.

Initially, a flat disc or right circular cylindrical blank 20, which may typically comprise aluminum and which is not shown in FIG. 1, is placed within the entrance aperture 14 of the die means 12 and is supported about its periphery by the annular shoulder 18. Thereafter, the punch control network 50 will move the punch 30 toward the die means 12 to bring the annular end face 34 into abutment with the work blank 20, and under a pressure which, in combination with that of the die, exert axial and radial stresses on the blank that are just short of the stress required to cause flow of the blank material.

Thereafter, the mandrel and cushion control network 44 will move the cushion 24 upward to close the extrusion orifice 22 and bring the face 28 into abutment with the work blank 20 and at the same time will move the mandrel 36 toward the die means 12 to bring the end face 42 into abutment with the work blank 20.

Referring to FIG. 2 in more detail, it is seen that after the end face 42 of the mandrel 36 contacts the work blank 20, continued downward movement of the mandrel 36 will exert on the work blank 20, in combination with the punch and die pressures, sufficient pressure to cause the blank to forwardly extrude through the extension orifice 22. During such downward movement of the mandrel 36, the cushion 24 will move therewith to prevent the material of the work blank 20 from extruding ahead of the end face 42 of the mandreel 36.

The cushion 24 may be locked with respect to the mandrel 36 such that the distance between them remains equal to the blank thickness, or, the cushion may act independently of the mandrel to reduce the thickness of the blank, in which case the cushion 24 would be spring loaded to exert a predetermined upward pressure on the work blank while at the same time moving in unison with the mandrel.

During the forging of the work blank 20, as illustrated in FIG. 2, the engagement between the punch 30 and the work blank is such that there will be some reverse extrusion of the mandrel of the blank as the mandrel 36 is moving from its initial position toward the extrusion orifice 22 if it is desired to reduce the thickness of the blank material from its original thickness. If reduction of blank thickness is not desired or required, the punch can be locked in position or otherwise made operative to exert pressure on the blank, in this phase of the process, to prevent back extrusion, and to provide a pressure that, in combination with the pressure of the mandrel 36, the cushion 24 and the portions of the die means 12 engaging the work blank, subject the blank to multi-axial stresses that are required for extruding the material of the blank.

As the movement of the mandrel 36 continues until, as best seen in FIG. 3, the end of the tapered surface 40 of the mandrel has entered the cylindrical portion of exit aperture 16, the punch 30 remains loaded and the mandrel 36 and the cushion 24 continue their joint movement. Thereafter, as best seen in FIG. 4, the mandrel 36 and the cushion 24 continue their uninterrupted downward movement but the punch control network 50 begins to move the punch 30 toward the extrusion orifice 22 such that the annular end face 34 of the punch 30 will exert a forward extrusion force, on that portion of the blank 20 remaining within the die means 12, at the same time as the mandrel 36 exerts a deep drawing and ironing force on the work blank 20. At this time the stresses on the work blank 20 effected by the punch 30, the mandrel 36, the cushion 24, and the die means 12 are such as to increase the ductility thereof to permit a much greater cross-sectional area reduction in the work blank being forged than otherwise possible.

Figure 5:
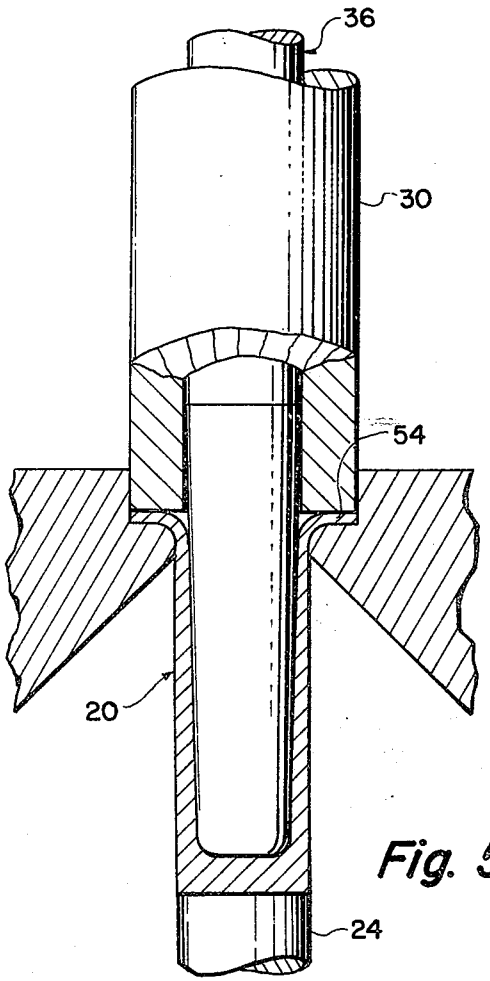
FIG. 5 provides a simplified perspective, partly broken away, of the apparatus of FIG. 1 with the component parts thereof positioned corresponding to fourth operational stage.

As best seen in FIGS. 3 and 4 after the face 42 of the mandrerl 36 has passed beyond the exit aperture 16 there remains only a flange portion 54 of the work blank 20 within the die means 12. The downward movement of the mandrel 36 and the cushion 24 continue along with that of the punch 30 until the thickness of the flange portion 54 within the die means 12 has been reduced to the wall thickness of the open end of the desired finished part. When this occurs the punch control network 50 will fix the punch 30 in position as best seen in FIG. 5. Thereafter, the punch 30 will function as a holder for the blank 20 and the mandrel will continue to advance to draw and iron the remainder of the blank, while the cushion continues retracting to its initial position (illustrated in solid line in FIG. 1), until the flange portion 54 of the work blank 20 has been drawn entirely through the extrusion orifice 22 completing the finished part.

Figure 7:
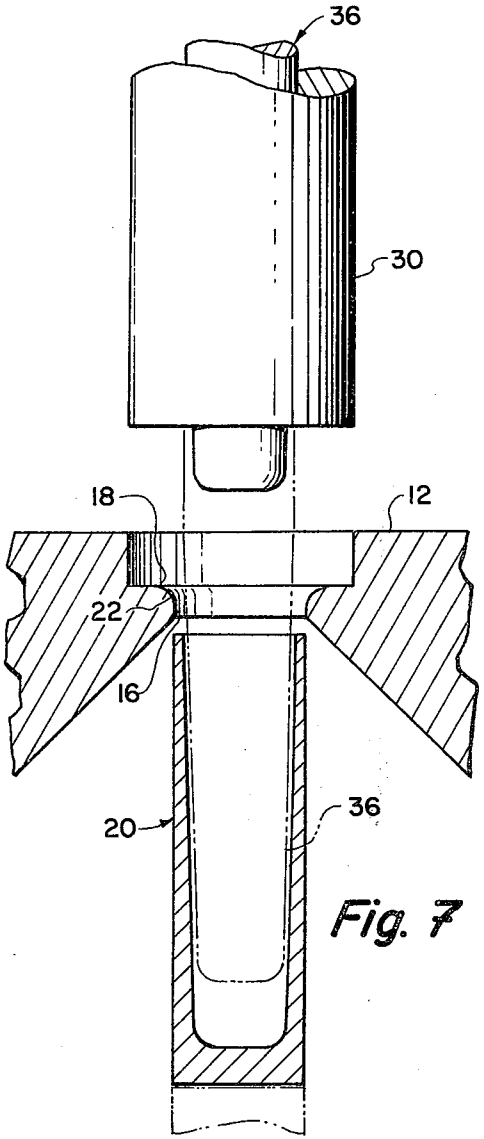
FIG. 7 provides a simplified perspective of the apparatus of FIG. 1 with the component parts thereof returned to said initial position and illustrating a completed workpiece stripped from the mandrel of the subject invention.
Figure 6:
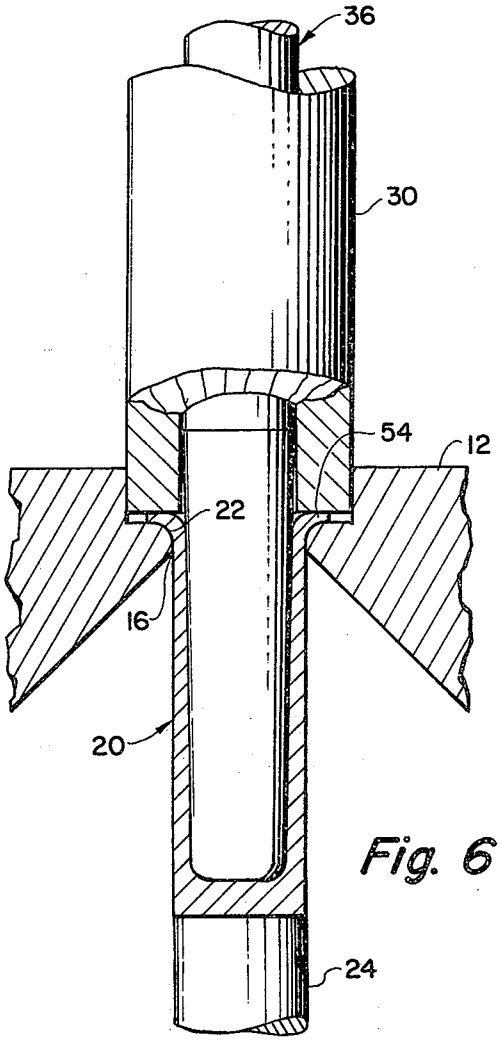
FIG. 6 provides a simplified perspective, partly broken away, of the apparatus of FIG. 1 with the component parts thereof positioned corresponding to said fourth operating stage.

Upon completion of the drawing of the workpiece 20, the cushion 24 will remain in its initial position and the mandrel and cushion control network 44 will disengage the mandrel 36 and the cushion 24 and begin retraction of the mandrel 36 through the extrusion orifice 22 to its initial position illustrated in FIG. 1. As best seen in FIG. 7, the retraction of the mandrel 36 will cause the die means 12 to strip the completed work blank 20 from said mandrel 36 because the outer diameter of the completed work blank 20 will now be too large to pass back through the extrusion orifice 22. After the flange 54 has been drawn completely through the extrusion orifice 22, the punch control network 50 will retract the punch 30 to its initial position (as seen in FIG. 1) and such retraction may occur either before, simultaneously with, or after the retraction of the mandrel 36 to its initial position.

Thus, it is evident that the completed part may be completely forged using a single punch 30, mandrel 36, cushion 24, and die means 12 and at a single work station during a single pass of the mandrel 36 through the extrusion orifice 22 of the die means 12.

It can readily be seen that many variations and modifications of the present invention are possible in the light of the aforementioned teachings, and it will be apparent to those skilled in the art that various changes in form and arrangement of components may be made to suit requirements without departing from the spirit and scope of the invention. It is, therefore, to be understood that within the scope of the appended claims, the instant invention may be practiced in a manner otherwise than is specifically described herein.

I claim:

1. A method of forging elongated shells of precisely controlled interior dimension including the steps of:

positioning a work blank within a die;

exerting a first axially directed force on said work blank to stress said work blank close to the stress required for extrusion;

exerting a second axially directed force on said work blank sufficient to extrude a first portion of said work blank through said die simultaneously with the exertion of said first force;

exerting a third axially directed force on said work blank in a direction opposite to said second force;

continuing said second and third axially directed forces and simultaneously increasing said first axially directed force sufficient to extrude a second portion of said work blank through said die;

decreasing said first axially directed force;

exerting an ironing force on said work blank being forged simultaneously with said continuing second and third forces; said first, second, third, and ironing forces combining to stress said work blank sufficient to significantly increase the ductility thereof, whereby said elongated shell may be forged in a continuous operation;

removing all of said forces upon completion of said shell.

2. The method of claim 1 wherein the second axially directed force is sufficient to reduce the original thickness of the blank material in contact with the mandrel to a predetermined, finished part thickness. precisely

3. The method according to claim 1, wherein said first axially directed force is exerted by a punch having a central opening therethrough and said second axially directed force is exerted by a mandrel passing axially through said central opening and having an end face which initially engages said work blank and a surface configuration conforming preciselyy to the desired inner surface configuration of said shell.

4. The method as recited in claim 3, wherein said third axially directed force is sufficient to prevent said work blank from extruding ahead of said end face of said mandrel and losing contact therewith.

5. The invention as set forth in claim 4, wherein said mandrel passes axially through said die and said shell is continuously forged during a single pass of said mandrel through said die in a single direction.

6. The invention as delineated in claim 5, wherein said shell is releasably secured to said mandrel during the passage of said mandrel through said die in said single direction and subsequently stripped from said mandrel by said die upon retraction of said mandrel through said die in the opposite direction.

7. A process for forging an elongated shell or the like from a metal blank and employing a die, a punch, a mandrel and a cushion, including the steps of:

placing said metal blank on a peripheral shoulder provided within the die and over an opening in the die;

closing the opening in the die with said cushion;

moving said punch into engagement with said blank and maintaining said punch against said blank under a force close to that required to extrude the metal of the blank;

moving said mandrel into engagement with said blank with sufficient force to extrude a portion of said blank through said die to form a shallow cup-shape workpiece having an integral side and end wall and an integral flange that is secured between said punch and said shoulder; said end wall being urged into engagement with said cushion by said mandrel;

moving said punch toward said shoulder to extrude material of said flange and side wall through said die opening while continuing said movement of said mandrel to advance said mandrel through said opening;

moving said cushion away from said opening at a predetermined rate as said mandrel advances therethrough to exert sufficient pressure on said end wall to thereby maintain contact between said end wall and said mandrel;

stopping the movement of said punch when the thickness of said flange reaches a predetermined value whereby said punch thereafter will releasably secure said workpiece within said die;

continuing said movement of said mandrel subsequent to stopping said punch to move the remainder of said workpiece through said opening;

retracting said mandrel through said opening to strip a completed workpiece therefrom; and retracting said punch.

8. The method as delineated in claim 7, wherein said mandrel moves continuously from an initial position through said opening to forge an elongated shell in a single pass of said mandrel through said opening.

9. The method according to claim 8, wherein said mandrel, said punch, and said cushion cooperate to increase the stress on said workpiece so as to increase the ductility thereof.

10. The process of claim 9, wherein said mandrel is provided with a surface geometry precisely conforming to that of the interior of the desired finished workpiece.

11. The invention pursuant to claim 10, wherein said punch is in the form of a hollow cylinder and said mandrel is configured as a tapered cylinder and disposed within said punch coaxially therewith for movement relative thereto.

12. The invention as set forth in claim 11, wherein said cushion is locaked to said mandrel from the time said mandrel engages said blank until said workpiece has completely passed through said opening.

13. The method of claim 12, wherein said punch, said mandrel, and said die cooperate to continuously forge, extrude, draw, and iron said workpiece during at least a portion of the passage of said mandrel through said opening.

* * * * *

UNITED STATES PATENT AND TRADEMARK OFFICE

CERTIFICATE OF CORRECTION

PATENT NO. : 3,977,225

DATED : August 31, 1976

INVENTOR(S) : Richard Couchman

It is certified that error appears in the above-identified patent and that said Letters Patent are hereby corrected as shown below:

| | |
|---|---|
| Col. 2, line 48 | Change "Bridgeman" to --Bridgman--. |
| Col. 4, line 29 | Change "word" to --work--. |
| Col. 4, line 50 | Change "contacct" to --contact-- |
| Col. 5, line 41 | After "to" insert --a--. |
| Col. 5, lines 63 & 64 | Change "beeneath" to --beneath-- |
| Col. 6, line 68 | Change "mandreel" to --mandrel-- |
| Col. 7, line 12 | Change "mandrel" to --material-- |
| Col. 7, line 46 | Change "mandrerl" to --mandrel-- |
| Claim 2, Col. 8, line 58 | Delete "precisely". |
| Claim 3, Col. 8, line 65 | Change "preciselyy" to --precisely--. |

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*